US006904978B2

(12) United States Patent
McGugan

(10) Patent No.: US 6,904,978 B2
(45) Date of Patent: Jun. 14, 2005

(54) SLIDE RAIL ADJUSTMENT FOR GRADER BLADE

(75) Inventor: Edward McGugan, Holyrood (CA)

(73) Assignee: Volvo Motor Graders Limited, Goderich (CA)

( * ) Notice: Subject to any disclaimer, the term of this patent is extended or adjusted under 35 U.S.C. 154(b) by 0 days.

(21) Appl. No.: 10/950,404

(22) Filed: Sep. 28, 2004

(65) Prior Publication Data

US 2005/0034879 A1 Feb. 17, 2005

Related U.S. Application Data

(62) Division of application No. 10/073,110, filed on Feb. 12, 2002, now Pat. No. 6,799,640.

(30) Foreign Application Priority Data

May 18, 2001 (CA) ..... 2348202

(51) Int. Cl.[7] ..... E02F 3/76
(52) U.S. Cl. ..... 172/795; 172/781
(58) Field of Search ..... 172/781, 789, 172/795, 796, 815; 37/234

(56) References Cited

U.S. PATENT DOCUMENTS 3,465,829 A * 9/1969 McCarthy et al. ..... 172/667
3,983,945 A * 10/1976 Hart et al. ..... 172/795
4,037,670 A * 7/1977 Atherton et al. ..... 172/795
4,058,174 A * 11/1977 Atherton et al. ..... 172/781
4,071,090 A * 1/1978 Easterling ..... 172/788
4,074,767 A * 2/1978 Cole ..... 172/781
4,084,643 A * 4/1978 Easterling ..... 172/795
4,105,078 A * 8/1978 Gilbert ..... 172/781
5,076,370 A * 12/1991 Stubben et al. ..... 172/781
5,687,800 A * 11/1997 Wilkening ..... 172/811
5,720,353 A * 2/1998 Wilkening ..... 172/795

FOREIGN PATENT DOCUMENTS

GB 1214896 12/1970

* cited by examiner

*Primary Examiner*—Robert E. Pezzuto
*Assistant Examiner*—Alexandra Pechhold

(57) ABSTRACT

A bearing support arrangement for a grader blade uses short stroke hydraulic cylinders to compensate for wear between slide bearings and slide rails of the grader blade. The cylinders are preferably pressurized by grease and a grease fitting is provided for each cylinder to provide convenient access, to allow service by the operator. Preferably the cylinders are located in a generally closed cavity between the bearing support holder and the slide bearing.

10 Claims, 5 Drawing Sheets

SLIDE RAIL ADJUSTMENT FOR GRADER BLADE

This application is a divisional application of U.S. patent application Ser. No. 10/073,110, filed Feb. 12, 2002 now U.S. Pat. No. 6,799,640.

FIELD OF THE INVENTION

The present invention relates to motor graders and in particular, relates to a bearing slide arrangement for a motor grader blade.

BACKGROUND OF THE INVENTION

The grading blade of a motor grader is subject to a host of adjustments and the nature of the mechanism and the nature of the application subjects the system to high loads. In addition, the operating conditions of the motor grader often cause material contamination and which is a particular problem for the slide mechanism of a grader blade as accelerated wear can occur.

Motor grader blades all typically include a slide adjustment for varying the position of the blade beneath the motor grader. Slide rails are provided on the rear surface of the grader blade and slide bearings are provided which engage the rails and allow the rail to slide therebetween.

A motor grader has many applications from rough grading, banking and snow plowing, to fine grading where it is desired to maintain precise grading tolerances. For rough grading applications, it is not critical if there is some excessive play due to wear between the slide rails and the bearings, however, this becomes more critical for precise applications. Most arrangements allow for some adjustment to reduce the tolerance between the bearings and the rails. Typically these systems use a number of large bolts and shims, however, the adjustment thereof is not convenient and requires specialized personnel and tools which are not normally available to the operator.

The present invention provides an alternate structure and method for supporting a motor grader blade which is easier to maintain.

SUMMARY OF THE INVENTION

A motor grader blade support arrangement comprises a grader blade with upper and lower slide rails attached to a rear surface of the blade and a blade support structure having a series of upper and lower bearing arrangements which engage the rails and accommodate longitudinal sliding movement of the blade and the slide rails. Each bearing arrangement includes a bearing support holder attached to the support structure with this bearing support holder supporting and retaining a slide bearing. At least some of the bearing arrangements include an adjustment mechanism to reduce tolerances between the slide bearings and the slide rails. The adjustment mechanism includes at least one short stroke hydraulic cylinder supported in the respective bearing holder and acting as an intermediary between the bearing holder and the slide bearing. Each hydraulic cylinder includes a grease fitting and the position of the hydraulic cylinder is adjusted using the grease fitting.

According to an aspect of the invention, the motor grader blade support arrangement has two hydraulic cylinders as part of each adjustment mechanism with these hydraulic cylinders being spaced in the length of the respective slide bearing.

In a further aspect of the invention, each bearing support holder having said adjustment mechanism includes an accessible port for each hydraulic cylinder and the grease fitting is located within the accessible port.

In yet a further aspect of the invention, the series of upper and lower bearing arrangements include at least two lower bearing arrangements, each having said adjustment mechanism and at least two upper bearing arrangements, each having said adjustment mechanism.

The present invention is also directed to a bearing support arrangement for a slide rail of a motor grader blade. The bearing support arrangement comprises a bearing holder, a removable bearing received in the bearing holder, and at least one adjustment mechanism controlling the position of the bearing in the holder. The adjustment mechanism is received in the holder and acts on a rear face of the bearing to space the rear face of the bearing from the holder as a function of the adjustment mechanism. The adjustment mechanism includes at least one short stroke hydraulic cylinder which is normally sealed with a fixed volume of fluid. The at least one hydraulic cylinder includes a fitting for varying the fixed volume of the fluid as required to compensate for bearing wear.

In yet a further aspect of the invention, the bearing support arrangement has a bearing holder which has a U-shaped channel in which the removable bearing is received.

In yet a further aspect of the invention, the adjustment mechanism includes two short stroke hydraulic cylinders spaced in the length of the bearing holder.

In yet a further aspect of the invention, the bearing on a rear surface thereof, has a recessed area which partially receives the hydraulic cylinders.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
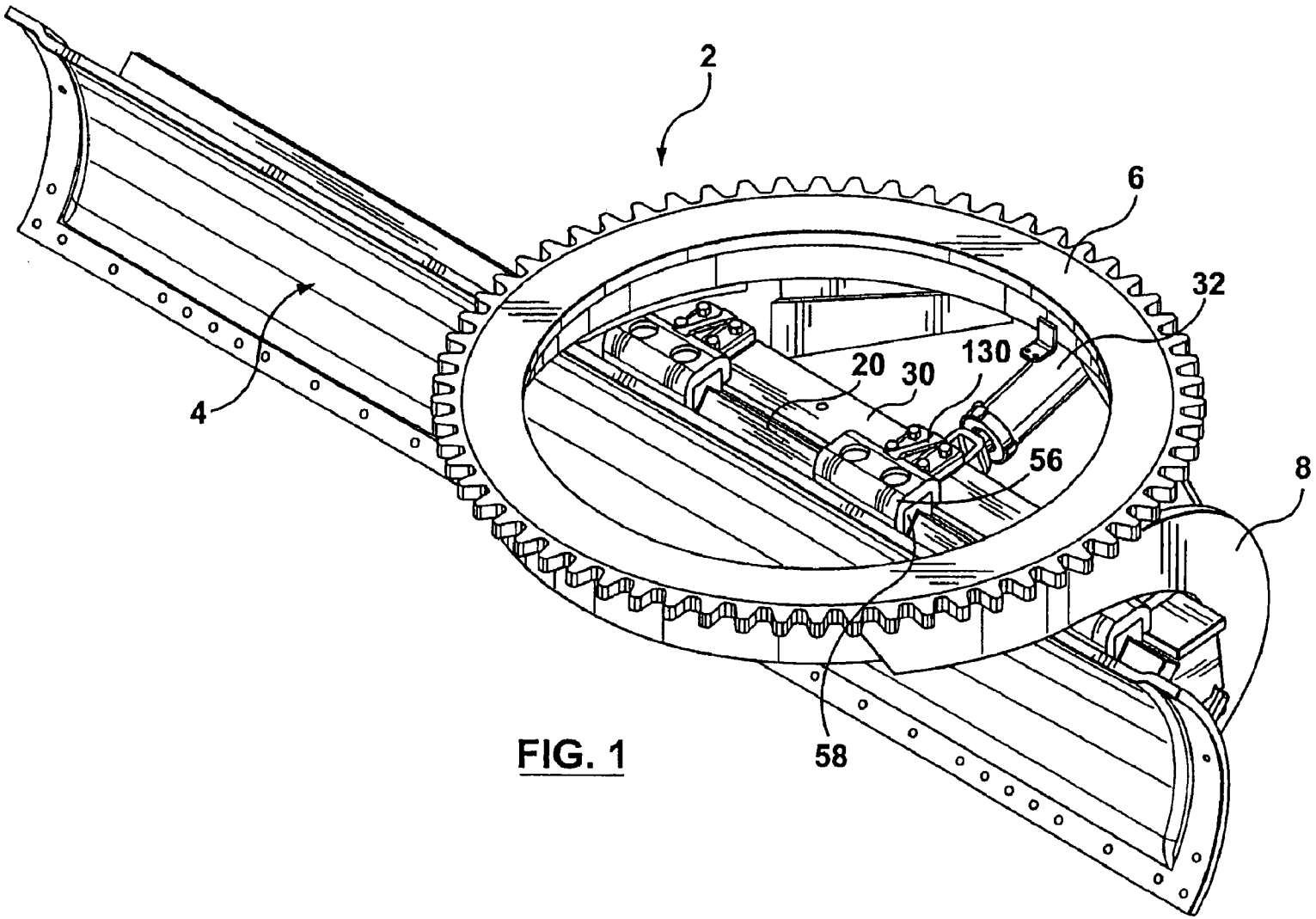
FIG. 1 is a perspective view showing a blade support arrangement for a motor grader.
Figure 2:
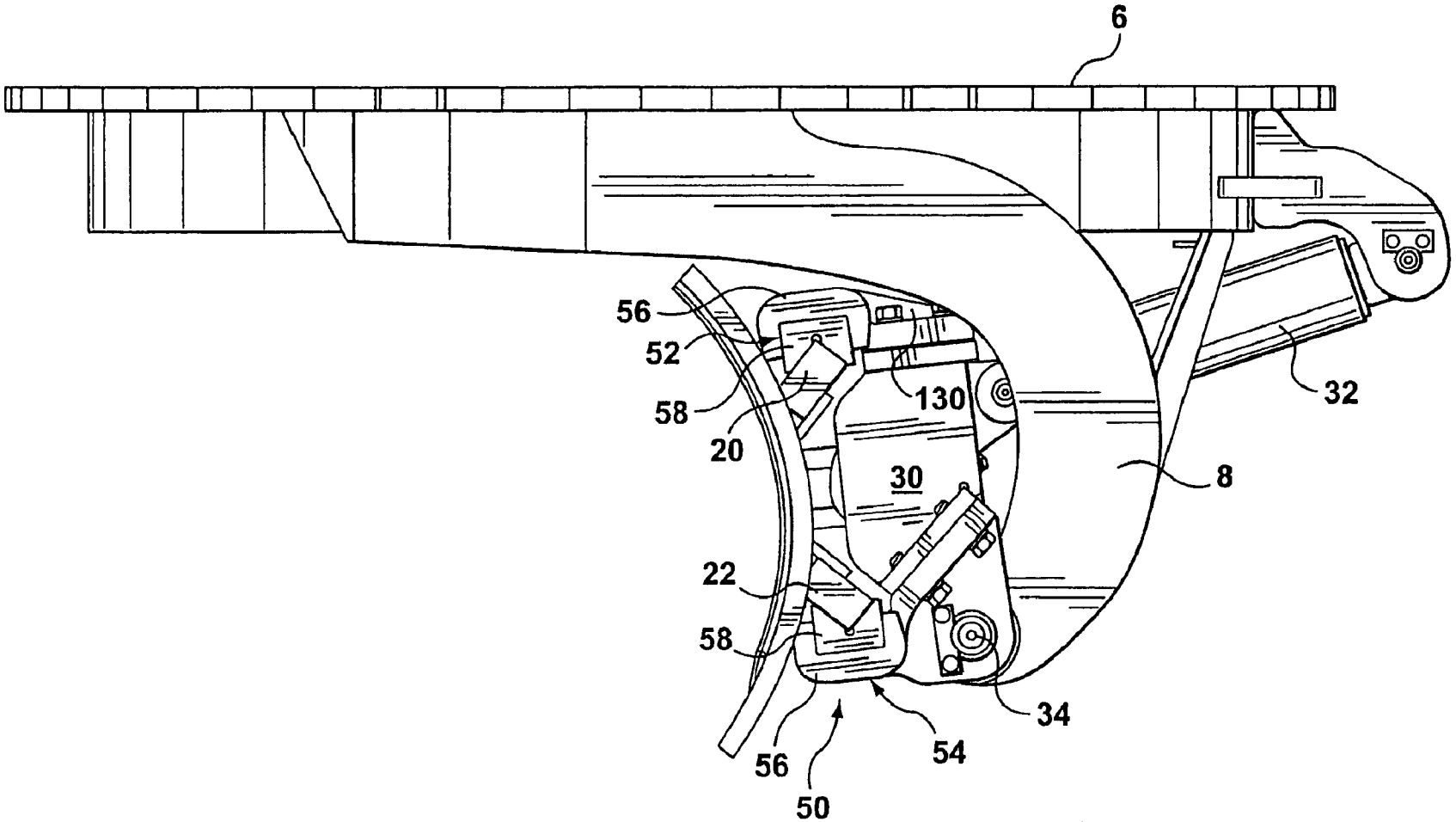
FIG. 2 is a side view of the blade support arrangement.

The blade support arrangement 2 for a motor grader is shown in FIG. 1 with the slidable blade 4 offset relative to the rotatable ring gear 6. The support arrangement includes downwardly extending arms 8 which pivotally support the center pivotting structure 30 at a lower edge thereof. This support structure 30 includes associated upper bearing arrangements 52 and lower bearing arrangements 54 attached thereto.

The grader blade 4 has an upper slide rail 20 fixed to a back surface of the blade and a lower slide rail 22 fixed to the back surface. The upper bearing arrangements 52 and lower bearing arrangements 54 serve to secure the blade 4 to the support structure 30 and allow sliding movement of the blade as the slide rails slide within the bearing arrangements. The hydraulic cylinder 32 allows tilting of the support structure 30 which in turn causes tilting of the blade 4.

Figure 3:
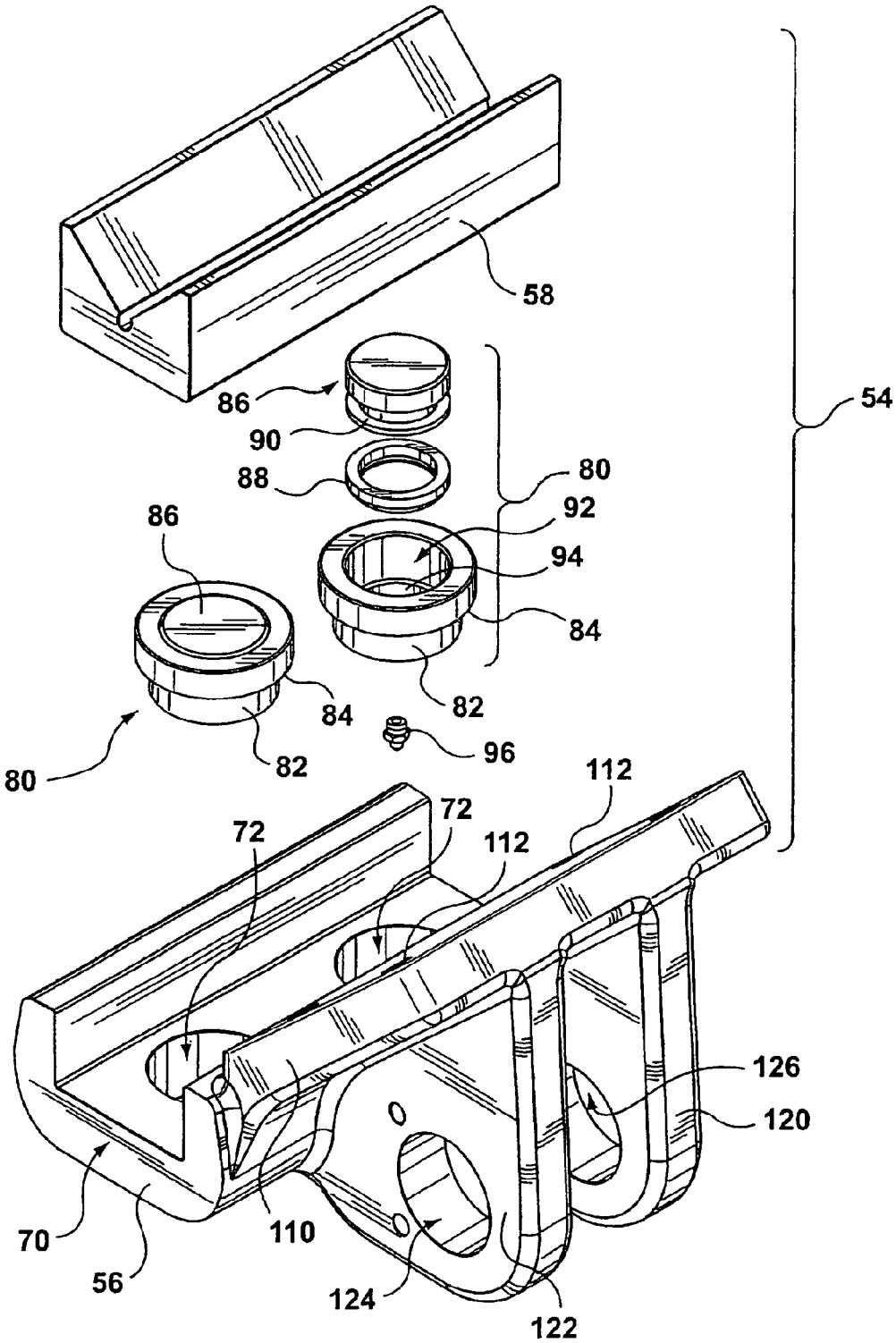
FIG. 3 is an exploded perspective view of a bearing arrangement.

Details of the lower bearing arrangement 54 are shown in the exploded view of FIG. 3. A bearing support holder 56 has a U-shaped channel 70 sized to receive and retain the slide bearing 58. The slide bearing 58 has a V-shaped top surface for engaging the lower slide rail. Two ports 72 are provided in the bearing holder and receive the short stroke hydraulic cylinders 80. These hydraulic cylinders include a stepped outer casing 82 having an annular step 84. This annular step engages the U-shaped channel with the lower part of the hydraulic cylinder being received within the respective port 72.

Figure 4:
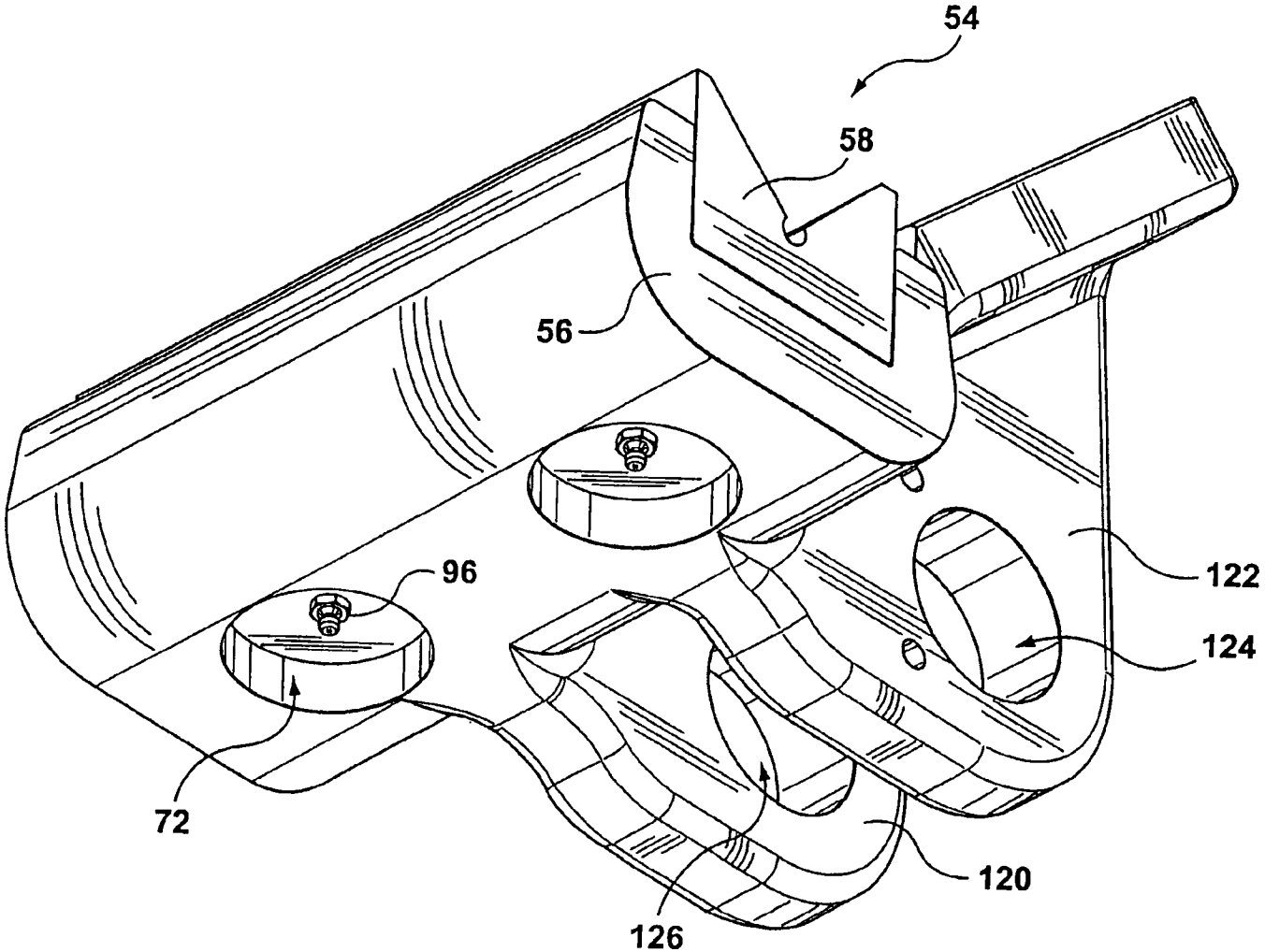
FIG. 4 is a perspective view showing the assembled bearing support arrangement.

The hydraulic cylinder includes a movable piston 86 having a ring seal 88 received in the groove 90 with the piston inserted into the cylinder 92. The cylinder is closed by the end wall 94 and the grease fitting 96 is provided in the end wall. The short stroke hydraulic cylinder is preferably filled with grease and allows adjustment of the position of the piston 86. This piston engages the rear surface of the bearing 58 and allows adjustment of the position of the bearing 58 relative to the holder. Two hydraulic pistons are provided and control the position of the bearing 58. The bearing is shown in its assembled condition in FIGS. 4 and 5. The piston exerts a pressure on the bearing and automatically adjusts for bearing wear.

Figure 5:
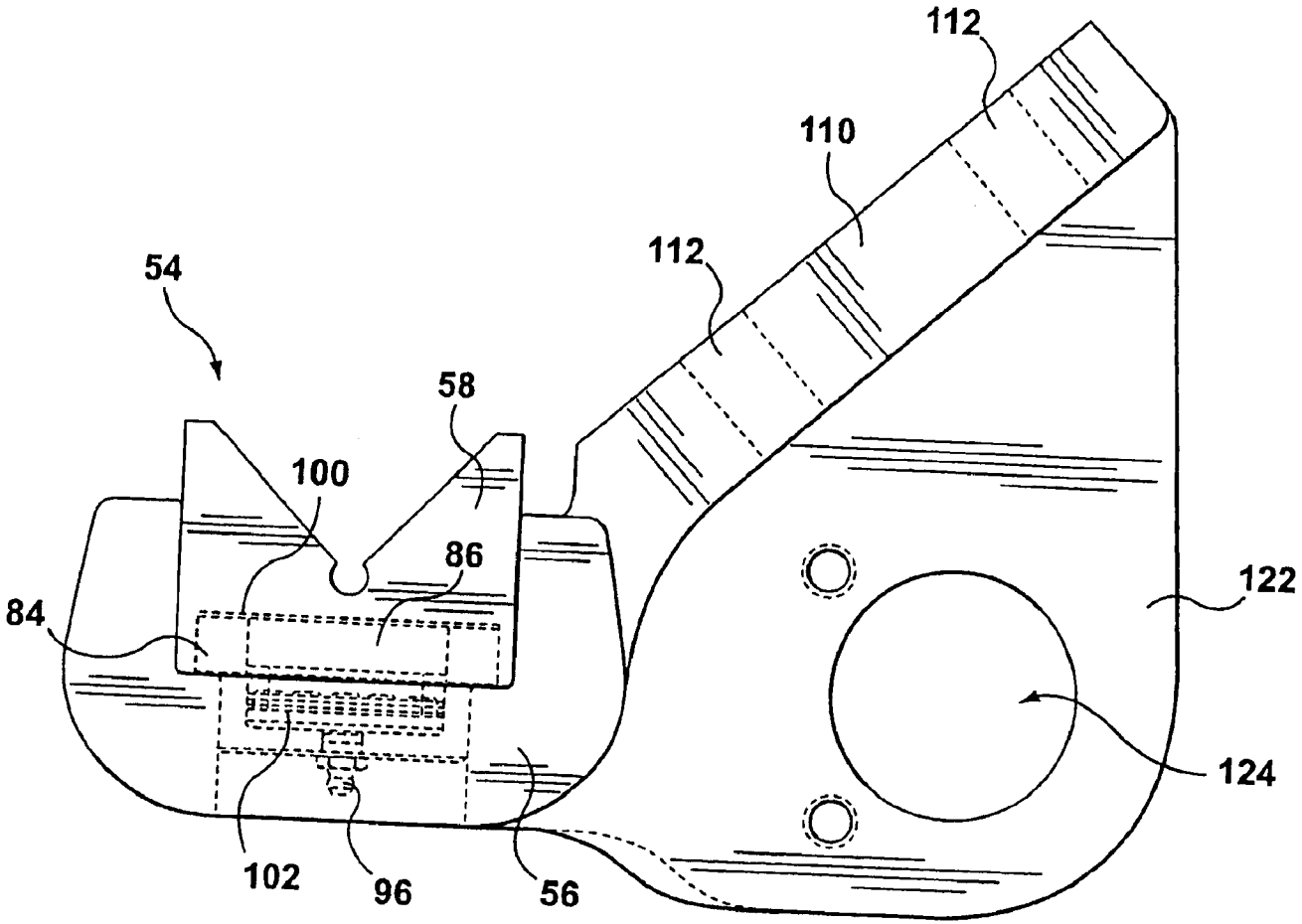
FIG. 5 is a partial sectional view showing the bearing support arrangement.

The grease fitting 96 as shown in FIG. 5 is exposed within the port 72 and allows the operator access to the fitting. As shown in the assembled view of FIG. 1, the grease fittings are accessible and the operator can adjust the position of the bearings relative to the holders and thus, decrease the tolerance merely by using a grease gun to increase the pressure and thereby alter the position of the pistons 86 within the hydraulic cylinders. Thus the operator during normal maintenance or during his initial morning walk around the grader or as desired, can easily correct for any wear between the slide rails and the bearings. In this way, the operator can reduce wobble of the blade and is able to have greater control of the blade on a daily basis.

The drop in hydraulic cylinders are generally located within a substantially closed cavity between the bearing holder and the slide bearing.

The lower holder 54 has two flanges 120 and 122 and these flanges are spaced one from the other to allow the insertion of the downwardly extending arm 8. Bearings are provided within the ports 124 and 126 and thus provide for the pivotting motion of the support structure 30. The support structure 30 is mechanically fastened to the lower bearings through the outwardly extending securing flange 110 having four ports 112. Typically these will be secured by a nut and bolt arrangement. The securement of the holder can be relatively straightforward as fine adjustment of the position of the bearings is accomplished by the short stroke hydraulic cylinders.

As shown in FIG. 1, the upper bearing holder is of a similar design, however, the flanges 120 and 122 are not present. The upper bearings hold the securing flange 110, and a gusset 130 is provided centrally on the flange.

It has been found that this blade support arrangement provides improved control of a motor grader blade, is convenient to adjust and is not particularly prone to maintenance. It can further be appreciated should one of the seals of the pistons fail, the result will be perhaps some leakage of grease which will merely improve the lubrication of the bearings and will not cause any substantial problems. Furthermore, there are two hydraulic cylinders per bearing holder and some maintenance of the tolerance is still achieved.

Although various preferred embodiments of the present invention have been described herein in detail, it will be appreciated by those skilled in the art, that variations may be made thereto without departing from the spirit of the invention or the scope of the appended claims.

The embodiment of the invention in which an exclusive property or privilege is claimed are defined as follows:

1. A motor grader blade support arrangement comprising:

a grader blade with upper and lower slide rails attached to a rear surface of the blade, a support structure having a series of upper and lower bearings which engage said rails and accommodate longitudinal sliding movement of said blade and slide rails;

each bearing being supported and retained by a bearing support holder attached to said support structure;

at least some of said bearings including an adjustment mechanism to reduce tolerances between the bearings and the slide rails, said adjustment mechanism including at least one short stroke hydraulic cylinder supported in said respective bearing support holder and acting as an intermediary between said bearing holder and the bearing thereof, each hydraulic cylinder including a grease fitting and the stroke of said cylinder is adjusted using said grease fitting.

2. A motor grader blade support arrangement as claimed in claim 1 wherein said adjustment mechanism includes two hydraulic cylinders spaced in the length of the respective bearing.

3. A motor grader blade support arrangement as claimed in claim 2 wherein each bearing support holder having an adjustment mechanism includes an accessible port for each hydraulic cylinder and said grease fitting is located within said accessible port.

4. A motor grader blade support arrangement as claimed in claim 2 wherein said series of upper and lower bearings includes at least two lower bearings each having said adjustment mechanism and at least two upper bearings each having said adjustment mechanism.

5. A motor grader blade support arrangement as claimed in claim 3 wherein said series of bearings includes at least two lower bearings each of which includes said adjustment mechanism and at least three upper bearings all of which have said adjustment mechanism.

6. A motor grader blade support arrangement as claimed in claim 5 wherein said hydraulic cylinders are filled with grease under pressure in excess of 3000 psi.

7. A motor grader blade support arrangement as claimed in claim 1 wherein each hydraulic cylinder is of a diameter in excess of 1.5 inches.

8. A motor grader blade support arrangement as claimed in claim 7 wherein the operating stroke of each hydraulic cylinder is less than 1 inch.

9. A motor grader blade support arrangement as claimed in claim 6 wherein each hydraulic cylinder includes a stepped outer casing and said bearing holders include ports which partially receive said hydraulic cylinders with the steps thereof abutting said bearing holder.

10. A motor grader blade support arrangement as claimed in claim 9 wherein each bearing is recessed on a back surface thereof and cooperates with said bearing holders such that said hydraulic cylinders are captured between their respective bearing and the respective bearing holder.

* * * * *